United States Patent [19]

Fister, Jr.

[11] 4,232,899

[45] Nov. 11, 1980

[54] SEATING UNIT AND METHOD OF CONSTRUCTION

[75] Inventor: Lee H. Fister, Jr., Centerville, Ohio

[73] Assignee: August Incorporated, Centerville, Ohio

[21] Appl. No.: 45,194

[22] Filed: Jun. 4, 1979

[51] Int. Cl.[3] ..... A47C 27/00

[52] U.S. Cl. ..... 297/229; 297/455

[58] Field of Search ..... 297/218–229, 297/456, 455, 454, DIG. 1; 5/402, 470, 471

[56] References Cited

U.S. PATENT DOCUMENTS

| | | | |
|---|---|---|---|
| 1,704,703 | 3/1929 | Fry | 297/226 |
| 2,568,398 | 9/1951 | Johnson | 5/402 |
| 2,644,508 | 7/1953 | Weill | 297/218 |
| 3,025,104 | 3/1962 | Murphy | 297/218 |
| 3,152,835 | 10/1964 | McKie | 297/226 X |
| 3,311,408 | 3/1967 | Sarvas | 297/218 |
| 3,586,370 | 6/1971 | Barecki | 297/219 |
| 3,630,572 | 12/1971 | Homier | 297/219 |
| 3,804,457 | 4/1974 | Hellman | 297/219 |
| 3,988,034 | 10/1976 | Fister, Jr. | 297/455 |
| 4,092,049 | 5/1978 | Schoblom | 297/219 |

*Primary Examiner*—Francis K. Zugel

*Attorney, Agent, or Firm*—Wood, Herron & Evans

[57] ABSTRACT

The invention herein disclosed relates to an improved method of upholstering seating units having rigid frames. After the rigid frame is constructed and various surfaces including its seat and back portions covered with a resilient foam layer, an upholstery cover is positioned over the frame and secured thereto through the use of rigid rods and swivel snap clips. The rigid rods are enclosed in fabric pockets within the upholstery cover. The swivel snap clips are connected to the rigid rods at one end and to eyebolts in the rigid frame at their other end.

6 Claims, 4 Drawing Figures

SEATING UNIT AND METHOD OF CONSTRUCTION

BACKGROUND OF THE INVENTION

This invention relates generally to a method of upholstering seating units having a rigid frame and to the seating unit produced thereby. More particularly, the present invention is primarily directed to contemporary seating units, although it has application as well to more traditional seating units.

Contemporary seating units are generally of two types of construction. One is the all foam type construction. One form of such construction is disclosed in my U.S. Pat. No. 3,988,034. The other type of construction utilizes an internal or external rigid frame. This invention is directed to the latter type construction.

More particularly, it has been an important object of the present invention to provide a method of constructing a contemporary seating unit where a rigid frame can be quickly and easily upholstered and where that upholstery can be quickly and easily replaced by the user when it has become worn, soiled or otherwise unserviceable.

It has been another object of this invention to provide such a method whereby uniform tension may be applied to the upholstery material so that aesthetically pleasing contours may be readily obtained.

It is a further important objective to provide such a method whereby a neat, clean and unwrinkled upholstery surface is provided and is maintained even after a substantial amount of usage.

SUMMARY OF THE INVENTION

The contemporary seating units of the present invention are characterized by their unencumbered appearance and by their clean, unbroken, smooth lines. Such an appearance is readily observable from my design patent application Ser. No. 21,079, filed Mar. 19, 1979, incorporated by reference herein, illustrating a chair produced in accordance with the method disclosed herein. The method of construction employed greatly facilitates the upholstering of the seating unit and also quite significantly increases the ease with which the unit may be reupholstered. This is an especially important feature of my invention since the contemporary seating units of the present invention are especially adapted for use in public reception and seating areas where the units are subjected to substantial usage. Under such conditions the units must be frequently replaced or reupholstered. The latter has not in many instances been a viable alternative because the units have to be withdrawn from service for sometimes relatively lengthy periods of service so that skilled workers can reupholster them.

The present invention provides a method whereby a person may quickly and easily reupholster a seating unit without any prior training. Cutting or sewing of fabric, stapling, gluing or other conventional upholstery techniques are not required in order to install the upholstery material on the seating frame. On-site replacement can be easily accomplished.

Another important advantage of this invention is the uniformity and reproducibility of the method. Such insures that the seating unit may be reupholstered without attendant unexpected difficulties.

All of the advantages just described are achieved through the provision of the following basic elements; a rigid frame; an upholstering cover that is preassembled in such a fashion that it has pockets sewn therein around its sides and in two other locations; rigid rods within said pockets; and rigid securing means attached at one end to said rigid rods and at the other end to said rigid frame. More particularly, the rigid frame includes elements forming sides, seat and back portions, and transverse cross members between the sides thereof. The seat and back portions are provided with resilient webbing strips and a resilient foam layer. The upholstery cover with its rigid rods is slipped over the frame so formed and secured to the transverse cross members by securing means comprising swivel snap clips operably connected to the rigid rods and to eyebolts in the frame. Such means are easily removed and the upholstery cover easily removed should it subsequently be decided that the unit should be reupholstered. The particular placement and location of the rigid rods, securing means and transverse cross braces provides a seating unit free of upholstery wrinkles and with a smooth, glove-like fit.

DESCRIPTION OF THE PREFERRED EMBODIMENT

The method and seating unit of the present invention will be more particularly described in accordance with the drawings wherein:

FIG. 3 is a figure similar to FIG. 1 showing the cover partly installed.

The following description is in reference to providing a contemporary chair of the type shown in my aforesaid design patent application. As shown therein, such a chair may be assembled along with other chairs and chairs having different angulated bases to provide an almost infinite variety of seating arrangements. While the following description is so directed, it will be understood that substantially different appearing seating units may be constructed utilizing the method of my invention.

Figures 4, 5:
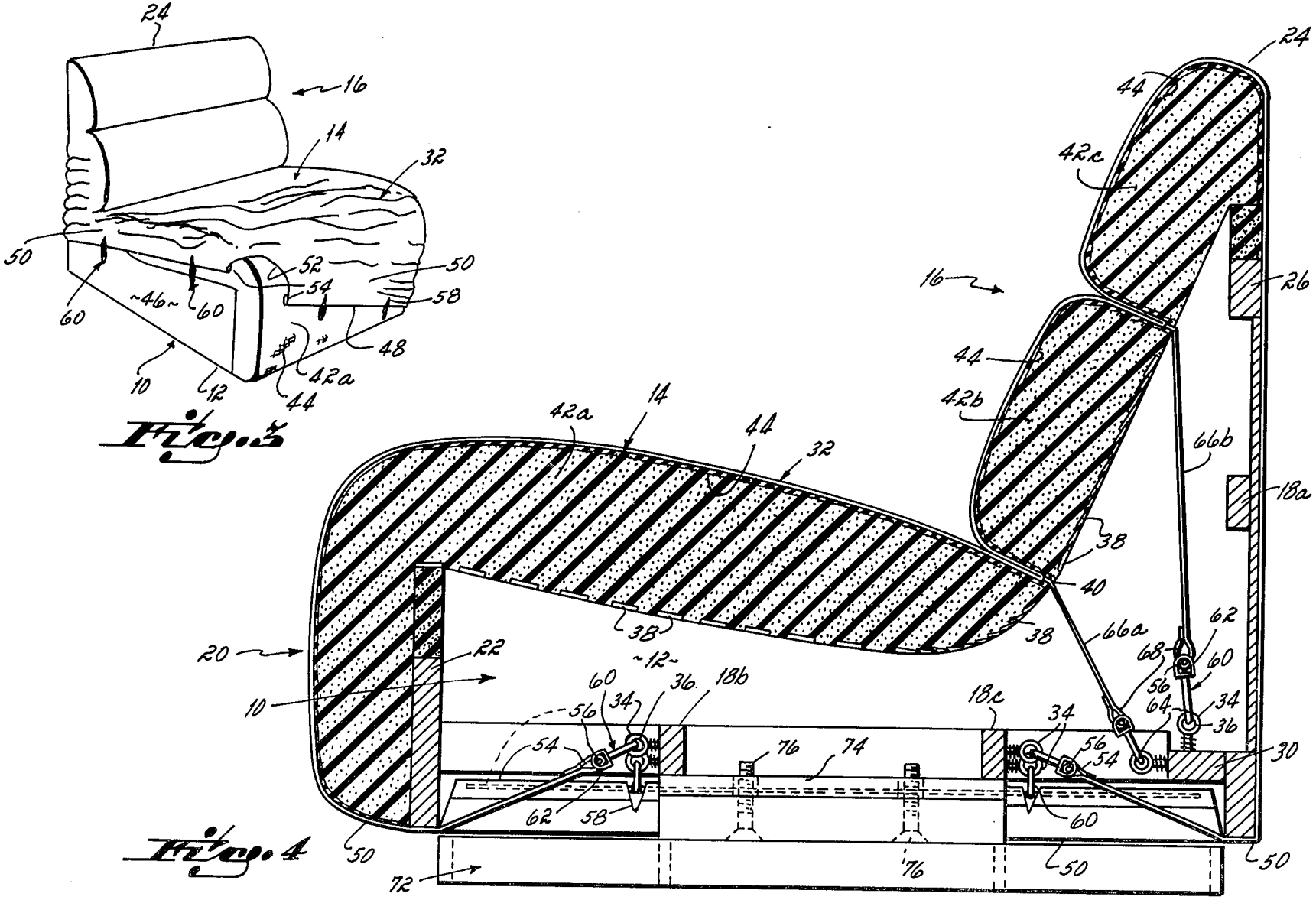
FIG. 4 is a longitudinal cross-sectional view illustrating the upholstery cover installed.

Referring to FIG. 4, there is depicted there a rigid chair frame 10. This rigid chair frame 10 is made from any suitable wood. It comprises a various number of elements including curvilinear side portions 12. Each side portion 12 is made from wood pieces that, in their assembled form, define the side of the seat portion 14 and back portion 16 of the frame 10 and the resultant chair.

Between the side portions 12 are secured a plurality of transverse cross members or braces 18. They are secured by conventional means as, for example, by dowels and staples, not shown. They may conveniently be made from wood. The transverse cross members 18 are shown with one (a) extending between the side portions 12 forming the back portion 16, and two (b) and (c) extending between the side portions forming the seat portion 14.

At the front 20 of the chair frame 10 is a wooden front member 22 extending between the side portions 12. At the top 24 of the chair frame 10 is a wooden top member 26 joining the side portions 12. At the back 16 of the rigid chair frame there is also a wooden back member 30 connecting the side portions 12. With respect to the function of back member 30 in the upholstery method of my invention, it serves the same purpose as do transverse cross members 18(*b*)–(*c*), and when I refer to the latter herein, it will also be understood that I am referring to back member 30 as well.

The transverse cross members 18(*b*)–(*c*) serve to strengthen the chair frame 10 as well as to provide locations for securing thereto an upholstery cover 32, described in more detail hereinafter. In order to secure said cover 32 to the cross members 18(*b*)–(*c*), metal eyebolts 34 are provided. Such eyebolts 34 are of conventional design and have their threaded portion screwed into the cross members 18(*b*)–(*c*) having the circular "eye" portion 36 exposed for cooperation with the upholstery cover as described later. Preferably, the eye portion 36 is coated with a rubbery or plastic material.

The positionment of the eyebolts 34 as shown in FIG. 4 is especially significant when the chair described in my aforesaid design patent application is constructed in accordance with the present invention. In this particular embodiment, four eyebolts 34 are used in connection with cross member 18(*b*), four eyebolts 34 in connection with cross member 18(*c*) and four eyebolts 34 in connection with back member 30.

The rigid chair frame 10 has affixed thereto a plurality of resilient webbing strips 38 of conventional construction. One end of the strip 38 is secured as by stapling to one side portion 12 and the other end secured to the other side portion 12. Strips 38 spanning the side portion 12 forming the seat portion 14 of the chair are spaced apart a slight distance. Such strips 38 spanning the side portions to form the back 16 of the rigid chair frame 10 overlap one another with a space 40 therebetween at a location which will generally correspond to the juncture of the seat 14 and back 16 portions of my chair. The purpose for such space 40 will be more fully described hereinafter.

Overlying the webbing strips 38 are resilient foam pieces 42(*a*)–(*c*) that are designed and secured to the rigid chair frame as follows: foam piece 42(*a*) covers the seat portion 14 and the front 20. It is fabricated from polyurethane foam which is covered with a polyester knit fabric 44. The front of the foam piece 42(*a*) is secured to the front 20 by any suitable means, as for example, by gluing. Middle foam piece 42(*b*) is a rounded piece of foam covered with polyester fabric 44 and is secured to the back portion 16 of the frame by any suitable means. Top foam piece 42(*c*) is another piece of foam material covered with polyester fabric 44. It is secured to the back portion 16 by suitable means and covers the top member 26. The foam construction just described provides excellent comfort and back support. Preferably, foam pieces 46 are adhesively secured to the side portions 12.

Upholstery cover 32 is a one-piece cover having a large opening 48 of a size sufficient to enable one to slide the cover 32 over the rigid chair frame 10. In most instances the cover 32 will be made from a plurality of upholstery pieces sewn together. In its preferred form, the opening 48 of cover 32 is defined by four sides 50 which in plan view form a square or rectangle of a sufficient size to slip over the chair. At the juncture of each side 50 with the others, the upholstery fabric material is split 52 for reasons that will become more apparent below.

Figure 1:
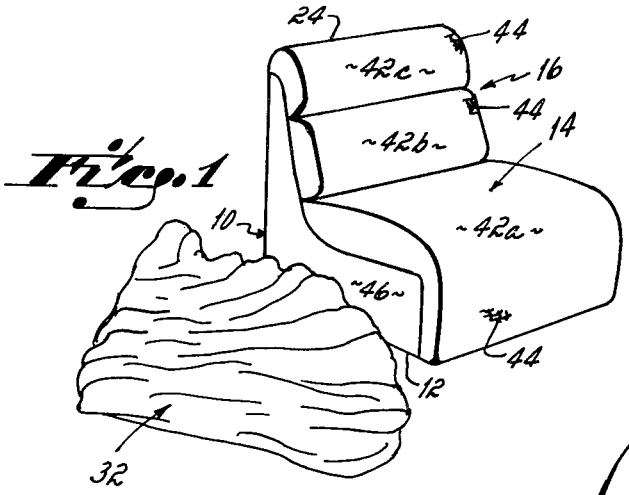
FIG. 1 is a disassembled perspective view illustrating a rigid chair frame and upholstery cover.
Figure 2:
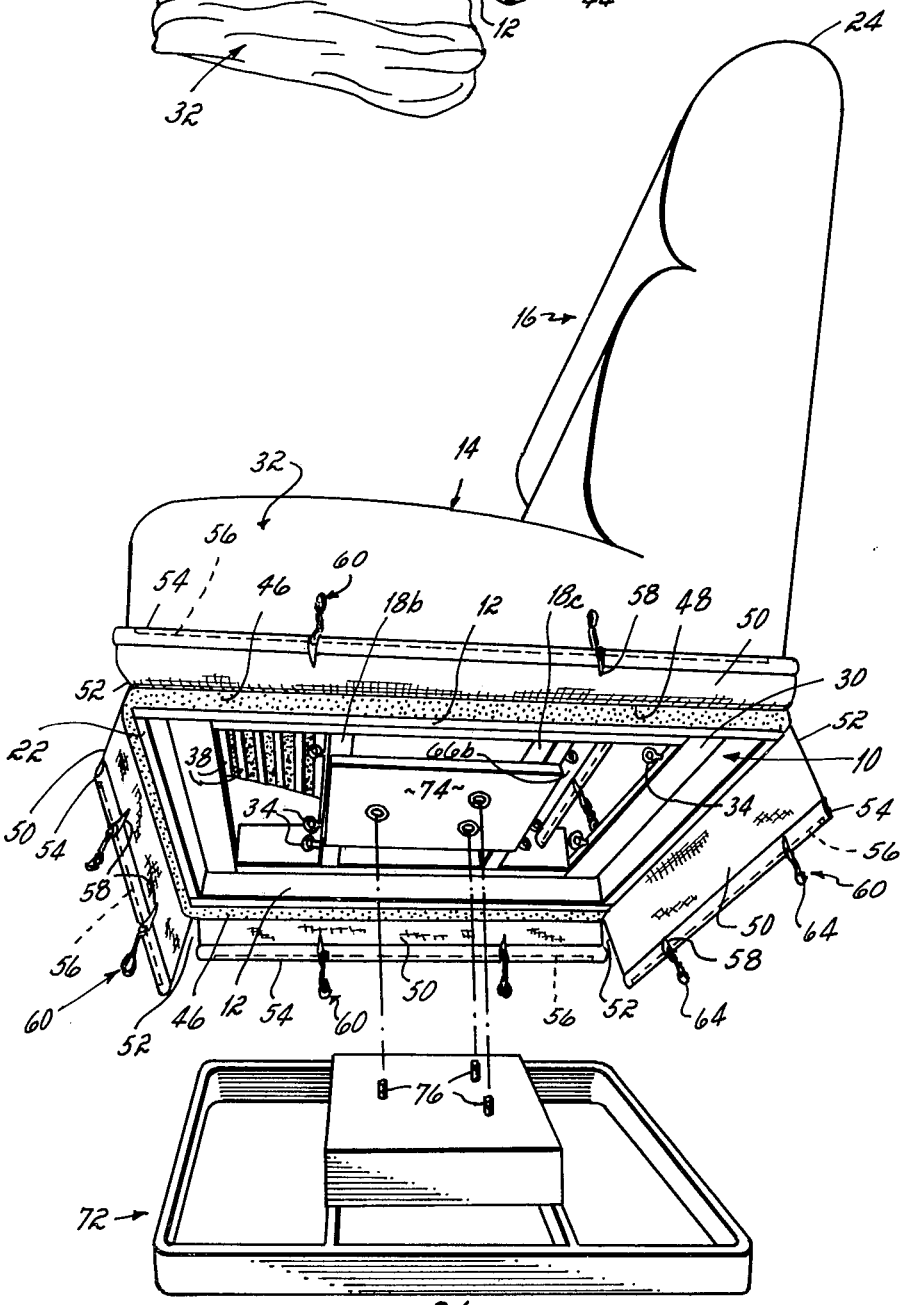
FIG. 2 is an exploded perspective view of the bottom of the chair of FIG. 1.

Referring to FIG. 2, each side 50 of the cover 32 is provided with a fabric pocket 54 along its bottommost edge. The pockets are sewn into the upholstery cover 32. Cooperating with the fabric pockets 54 and various other elements of the chair in a manner more apparent from the following description are rigid rods 56. Such are preferably metal. The inside diameter of the fabric pockets 54 are large enough so that they can receive the rigid rods 56. The fabric pockets extend substantially across each side 50 of the cover 32. Intermediate the ends of each fabric pocket 54 at least two slits 58 are provided.

During the insertion of the rigid rods 56 into the fabric pockets 54, snap swivel clips 60, having a circular, swivel eye 62 at one end, are positioned in slits 58 and the ends of the rods 56 are inserted therethrough. The snap clip portions 64 of the clips 60 are then clipped to the eyes 36 of eyebolts 34. Snap swivel clips 60 are identical to those frequently found on dog leashes. The preferred assembly and disassembly method is detailed below.

Referring to FIG. 4, the upholstery cover 32 includes on the inside thereof two cloth casings 66(*a*) and (*b*). One end of each casing 66 is fastened, as by sewing, to the underside of the upholstery cover. The other end of the casings 66 has fabric pockets 68. These pockets 68 are similar to fabric pockets 54 and also have slits, not shown, intermediate their ends. Pockets 68 also have inserted therein rigid rods 56 each carrying snap swivel clips 60. Such snap clips 60 snap to eyebolts 34 on back member 30. One cloth casing 66(*b*) is slightly longer than the other casing 66(*a*).

Preferably, fabric pockets 54 and pockets 68 have one end sewed closed and means for closing the other end after the rigid rods 56 are inserted, as for example by the use of VELCRO ® tape.

If desired, a plinth base 72 may be used. If used, it can be attached to plate 74 secured to transverse cross braces 18(*b*) and 18(*c*). If not used, plate 74 is not required. Bolts 76 may be used for such purpose. If a plinth base 72 is used, it is important that a small space between the base and the rigid frame 10 is provided so that the upholstery cover 32 is not pinched.

Installation of the upholstery cover 32 over the rigid chair frame 10 with the plinth base 72 removed proceeds quickly and easily in the following manner.

All of the rigid rods 56, six in all, with the snap swivel clips 60, twelve in all, are positioned within cover pockets 54 and casing pockets 68. The cover 32 is then positioned on the frame 10 so that the longer cloth casing 66(*b*) is above the seat 14. Said cloth casing 66(*b*) is then inserted between the middle and top foam pieces 42(*b*) and (*c*). The upholstery cover 32 is then positioned over the top 24 and back 16 of the chair. Short cloth casing 66(*a*) is then inserted between foam pieces 42(*a*) and 42(*b*) and through space 40. The frame 10 is then turned on one side and the two snap swivel clips 60 of large cloth casing 66(*b*) are snapped to the two vertical eyebolts 34 on back member 30. The two snap swivel clips 60 of short cloth casing 66(*a*) are then snapped to the horizontal eyebolts 34 on back member 30. Having smoothed the fabric over the seat and back, the two snap swivel clips 60 in the side 50 are snapped to the outermost eyebolts 34 on each outside end of cross members 18(*b*) and 18(*c*). The chair is then swivel turned on its other side and the two snap swivel clips 60 of that side are snapped to the outermost eyebolts 34 of the other ends of cross members 18(*b*) and 18(*c*). The front and rear sides 50 are then secured by snapping the two snap swivel clips 60 of each to the two eyebolts 34 that are in the middle of cross member 18(*b*) and cross member 18(*c*). Lastly, if used, the plinth base 72 is installed.

Removal of the upholstery cover 32 is as simple as the installation. More particularly, the plinth base 72, if employed, is removed and the twelve snap swivel clips 60 are released. The cover 32 is folded back over the sides of the chair frame 10 and then "peeled" up until it is raised above the seat portion 14 and the tension released. The short cloth casing 66(*a*) and the long cloth casing 66*b*) are then removed from the spaces between the foam pieces 42(*a*), 42(*b*) and 42(*c*). The cover 32 may then be completely removed from the rigid frame 10.

I claim:

1. A seating unit comprising, a rigid chair frame having a front, a back, sides, and an occupant seating area having a seat and a back portion, rigid transverse cross members extending between said sides and attached securely thereto, a rigid back transverse member extending between said sides and attached securely thereto at the back of said frame, webbing strips extending between said sides in the area of the occupant seating area, a one-piece upholstery cover adapted to overlie the occupant seating area of said frame, said cover having a top side with a seat and back portion for occupant seating overlying the seating area of the frame, said seat and back portion of said cover having an underside, at least one fabric casing attached to the underside of said back portion, said cover having a bottom portion having side, front and back sides, each side having fabric pockets at their lowermost portion, rigid rods in each fabric casing and in each fabric pocket, clip means connected to said rigid rods at one end and having clips at the other end, a plurality of eyebolts secured to said transverse cross members and to said back member, said clip means securing the rigid rods in the fabric casings to said eyebolts in the back member, and said clip means securing the rigid rods in the fabric pockets of the side, front and back sides of the bottom portion to the eyebolts in the transverse cross members.

2. The seating unit of claim 1 wherein two fabric casings are attached to the underside of said back portion of said cover and are each secured by said clip means and rigid rods to the rigid transverse back member whereby said back portion of said cover is maintained in a relatively permanent fixed position.

3. The seating unit of claim 2 wherein at least two clips are attached to each rod in each casing and a like number of eyebolts are secured to said back member, said eyebolts being positioned so that the eyebolts cooperating with a rigid rod are at about a 90° angle with respect to the eyebolts cooperating with the other rigid rod in said other casing.

4. The seating unit of claim 3 wherein urethane foam rubber is interposed between the webbing strips and the upholstery cover and a plinth base is secured to the frame.

5. The seating unit of claim 3 wherein there are two rigid transverse cross members, and each rigid transverse cross member has at least four eyebolts secured thereto, said eyebolts cooperating with said clip means to secure the side, front, and back of the bottom portion of said fabric cover to said rigid transverse cross members.

6. The seating unit of claim 5 wherein the clip means are removably connected to the rigid rods and are clipped to the eyebolts whereby they can be easily removed from the eyebolts and the rigid rods.

* * * * *